US005631662A

United States Patent [19]

Lotterer et al.

[11] Patent Number: 5,631,662

[45] Date of Patent: May 20, 1997

[54] VEHICLE ANTENNA EMBEDDED IN ELASTOMERIC BODY

[75] Inventors: Norbert Lotterer, Eningen; Jürgen Deininger, Stuttgart, both of Germany

[73] Assignee: Mercedes-Benz AG, Germany

[21] Appl. No.: 554,166

[22] Filed: Nov. 6, 1995

[30] Foreign Application Priority Data

Nov. 4, 1994 [DE] Germany ..... 44 39 387.3

[51] Int. Cl.[6] ..... H01Q 1/32

[52] U.S. Cl. ..... 343/715; 343/873; 343/900

[58] Field of Search ..... 343/711–713, 715, 343/900, 901, 903, 905, 829, 830, 846, 873, 848, 878; H01Q 1/32

[56] References Cited

U.S. PATENT DOCUMENTS 2,572,995 10/1951 Dunbar ..... 343/830

2,668,187 2/1954 Von Wald et al. ..... 343/900

FOREIGN PATENT DOCUMENTS 4037712 6/1992 Germany .

9116508.3 2/1993 Germany .

9314147 2/1994 Germany .

*Primary Examiner*—Michael C. Wimer

*Attorney, Agent, or Firm*—Evenson, McKeown, Edwards & Lenahan P.L.L.C.

[57] ABSTRACT

The invention provides an aerial for a motor vehicle having an aerial base portion which can be fitted onto the body of a vehicle, and is provided with a capacitive ground coupling. According to the invention, the aerial base portion, ground coupling, aerial wire and the connected end of the high frequency line are embedded in a single component elastomer body which is provided with a locking configuration for locking in an opening of a wall of the body of the motor vehicle.

5 Claims, 1 Drawing Sheet

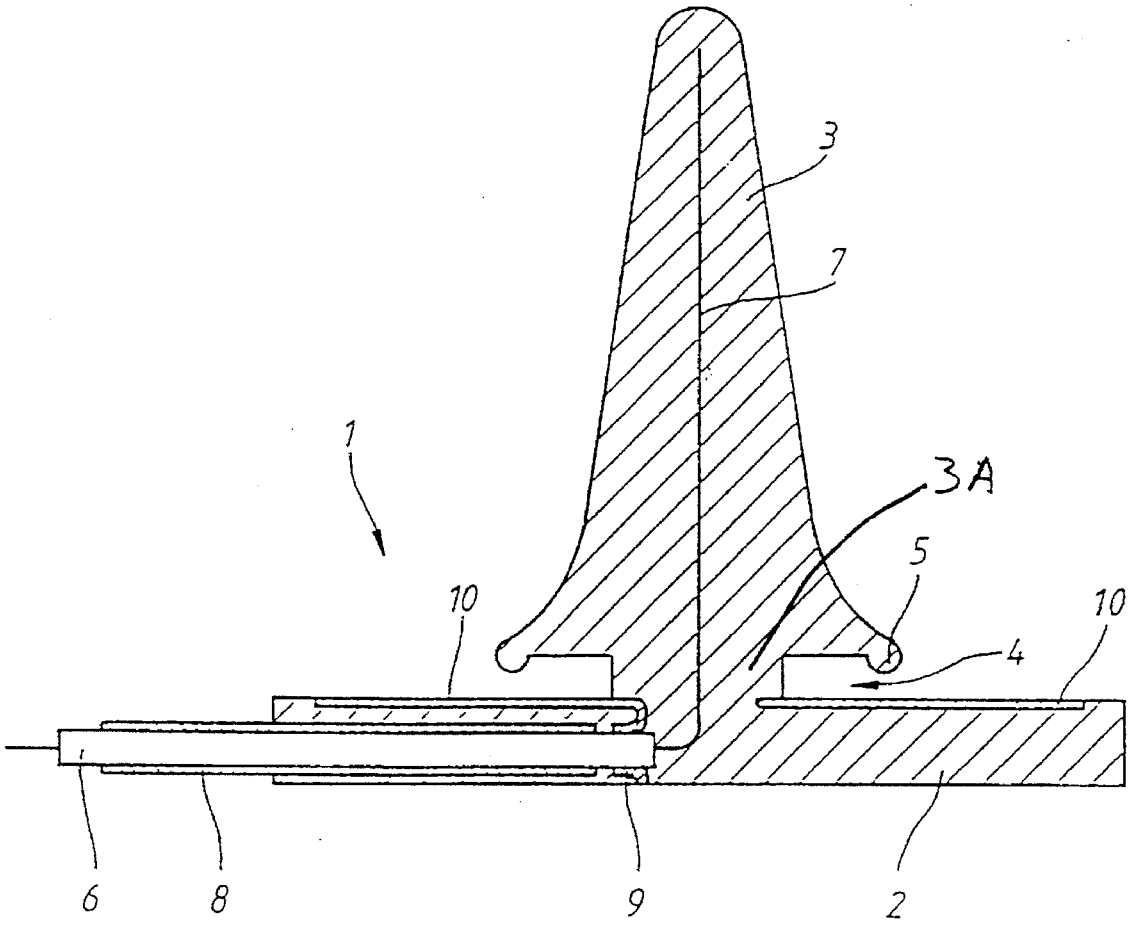
3
7
1
3A
5
10
10
4
6
8
9
2

VEHICLE ANTENNA EMBEDDED IN ELASTOMERIC BODY

BACKGROUND AND SUMMARY OF THE INVENTION

The invention relates to an aerial for a motor vehicle, with a capacitive coupling to ground in the region of an aerial base and with an aerial wire which, in the installed state, leads to an outer side of the vehicle and is connected to one end of a high frequency line.

German Patent Document DE 91 16 508 U1 discloses an aerial for a motor vehicle which can be fitted from the outside onto the body of a motor vehicle. An aerial tip for guiding the aerial wire can be screwed into an aerial base whose housing can be mounted on the outer skin of the body of a motor vehicle. The aerial is provided with a capacitive ground coupling, the aerial cable being conductively connected by a capacitive plate to the bottom of the aerial base. Furthermore, a dielectric is arranged between the capacitive plate and the outer skin of the body of the vehicle. As a result of the capacitive ground coupling, no direct connection is necessary between the ground of the aerial and the body of the vehicle.

Generally, known vehicle aerials have an upper part and a lower part which are screwed to one another during mounting, and secure between them the sheet metal of the body of the vehicle. The ground contact is usually made using sheet-metal claws. The aerial must be mounted from both sides of the body sheet metal.

The object of the present invention is to provide a motor vehicle aerial of the type mentioned above, which has the advantages of capacitive ground coupling and can be easily anchored in the body of the motor vehicle from one side.

This object is achieved according to the invention in that the aerial base, the ground coupling, the aerial wire and the connected end of the high frequency line are embedded by bonding, locking or casting in a single component elastomer body which is provided with a configuration, such as a ring, groove or flange, which locks in an opening in a wall of the body of the motor vehicle. (The high frequency line can be provided in the form of a cable or a plug.) By embedding the individual elements of the aerial of the motor vehicle in a single-component preform, joining or assembling the individual parts of the motor vehicle aerial is dispensed with. As a result of the locking arrangement, it is possible to anchor the motor vehicle aerial easily from one side, preferably from an underside, in a wall of the vehicle body, for example a vehicle body panel. The elastomer body is easily pushed from below, through the opening in the wall of the body of the vehicle to such an extent that the locking configuration of the elastomer body locks in the opening. The shape of the elastomer body can be adapted to the spatial circumstances in which the motor vehicle aerial has to be accommodated in the body of the vehicle.

In a refinement of the invention the elastomer body has a disk shaped base which can be positioned below the wall of the vehicle body, and the end of the high frequency line and a contact plate for capacitive ground coupling are embedded therein. The contact plate is in contact with the high frequency line, and is free towards one upper side. The connection of the high frequency line and the ground coupling is thus made invisible on the underside of the wall of the vehicle body.

In a further embodiment of the invention, the elastomer body has an elongated peg-like tip which connects to the base and (in the mounted state) projects through the opening in the wall of the vehicle body towards the outside, with the aerial wire at least partially molded therein. (Molding in this case also includes locking and bonding.) The peg-like tip projects horizontally from the outside of the wall in the vehicle body in order to perform reliably the respective transmitting or receiving function of the aerial.

In a further refinement, the elastomer body is assigned a connector which can be pushed axially into it from below. As a result mounting and a sealing effect are promoted.

In a further refinement of the invention, for locking in the opening in the wall in the vehicle body, the elastomer body has, between the tip and the base, a circumferential annular groove whose internal diameter is smaller than that of the opening. This annular groove also serves to provide a seal, it being possible for sealing also to take place radially.

In a further refinement a lower edge of the tip is provided in the region of the annular groove with a circumferential sealing lip for sealing the opening from one outer side of the wall of the vehicle body. As a result, the elastomer body additionally fulfills a sealing function in that it protects the opening in the wall in the vehicle body towards the outside against the penetration of wet or dampness. In other exemplary embodiments according to the invention other seals are provided which are effective from the inside or radially.

Other objects, advantages and novel features of the present invention will become apparent from the following detailed description of the invention when considered in conjunction with the accompanying drawings.

BRIEF DESCRIPTION OF THE DRAWINGS

The single FIGURE of the drawing shows a sectional view of the motor vehicle aerial according to the invention, in which all elements of the motor vehicle aerial are integrated in a single-component elastomer body.

DETAILED DESCRIPTION OF THE DRAWING

As shown in the FIGURE, a vehicle (1) has a high frequency line (6) to which an aerial wire (7) in the form of a lambda/4 probe is connected. In the embodiment illustrated, the vehicle aerial (1) is a two-way radio aerial. However, in the same way the vehicle aerial (1) is also suitable for other exemplary embodiments of the invention for pure receiving aerials. The vehicle aerial (1) is connected to a corresponding transmitting and/or receiving unit in the interior of the vehicle and has a capacitive ground coupling (9, 10) described in greater detail below.

The vehicle aerial (1) is anchored in an opening (not shown) in an outer wall of the body of the motor vehicle in a way also described in greater detail below. For this purpose, a hole is easily provided in the vehicle body panel which forms the outer wall of the body of the motor vehicle. Both the end of the high frequency line (6) which adjoins the aerial wire (7) and the aerial wire (7) itself as well as the capacitive ground coupling (9, 10) of the vehicle aerial (1) are embedded in a single-component preform made of an elastomer material. The individual parts of the vehicle aerial (1) are held in the elastomer body by means of encapsulation by injection molding, using an injection molding method. The elastomer material of the elastomer body has high resistance to aging and wear. As a result of the relatively high elasticity of the elastomer body any risk of injury to persons is eliminated.

As is well known to those skilled in the art, elastomers are polymers with a rubber-elastic behavior, which can be stretched or compressed at room temperature with strong reversibility. The number of elastomers existing and commercially available is very large. The following is a sampling of mechanically loadable elastomers which are suitable for the present invention: natural rubber, polyester urethane rubber, polyether urethane rubber, polychloroprene, chlorinated polyethylene, sulfonated polyethylene, styrene butadiene rubber, hydrated nitrile rubber, fluorinated rubber.

In the mounted state of the vehicle aerial (1), a disc-shaped base (2) of the elastomer body is arranged on an inner side of the panel of the vehicle body. The high frequency line (6) projects radially into the disc-shaped base (2), and is surrounded by an insulator (8). A front end of the high frequency line (6) is connected to the lambda/4 probe which serves as an aerial wire (7). (The high frequency line (6) may comprise a connector, which can be pushed axially into a corresponding opening in the elastomer body (3).)

The aerial wire (7) projects vertically upwards from the base (2) coaxially with respect to a longitudinal center axis of the disc-shaped base (2), through the opening in the wall in the vehicle body as shown in the FIGURE. Thus, in the region of connection to the high frequency line (6), the aerial wire (7) is bent at a right angle. The high frequency line (6) is insulated in this connected region, and surrounded by an annular coupling (9) which merges at the top with a thin, disc shaped contact plate (10). The disc-shaped contact plate (10) is embedded in the base (2) of the elastomer body in such a way that its upper side is flush with the upper edge of the base (2) and is thus exposed at the top towards the inside of the vehicle body panel.

The contact plate (10) is very thin, and thus foil-like. In a further embodiment of the invention this contact foil is of self-adhesive design. Depending on the spatial circumstances, the vehicle aerial (1) can be attached to various parts of the vehicle body such as the roof, rear lid, mud flap or the like. A capacitive ground coupling of the vehicle aerial (1) is easily achieved by means of the coupling (9) and the contact plate (10). The upper side of the base (2), including the disc-shaped contact plate (10), rests symmetrically around the hole on the underside of the body panel.

The elastomer body has an elongated peg-shaped tip (3) which projects vertically upwards from the base (2) and symmetrically with respect to its longitudinal center axis. The aerial wire (7) is embedded coaxially in the upwardly projecting tip (3) by encapsulation by injection molding. The tip (3) projects through the hole in the vehicle body panel towards the outside thereof, and vertically upwards from the outside of the vehicle body. The peg-like tip (3) is of hat shaped construction, with a circumferential annular groove (4) formed between the upper side of the base (2) and a lower edge of the tip (3). The annular groove (4) surrounds a neck (3A) of the elastomer body which connects the base (2) to the tip (3).

The internal diameter of the annular groove (4) is smaller than the diameter of the hole in the vehicle body panel, so that the elastomer body can easily be pushed upwards from below, with its tip (3) through the hole in the vehicle body panel, until the annular groove locks on the edge of the hole. In order to achieve a good fit of the elastomer body in the hole, the height of the annular groove (4) corresponds approximately to the thickness of the body panel. In the mounted state, the tip (3) is therefore located on the outside of the vehicle body panel, and the base (2) in contrast is located on the inside.

A locking configuration which engages positively with the opening in the body panel is thus easily provided by the annular groove (4) between the tip (3) and the base (2) of the elastomer body. In this and other exemplary embodiments of the invention, the locking configuration of the elastomer body of the vehicle aerial (1) is adapted to the respective dimensions in order to achieve a simple locking connection to the opening of the respective vehicle body wall, so that the vehicle aerial (1) can be slipped in easily from the underside of the vehicle body wall.

In order to seal the outside of the hole which forms the opening through the wall of the vehicle body, the tip (3) of the elastomer body has on its outer edge a circumferential sealing lip (5) which, in the mounted state, presses on the outside of the vehicle body panel around the hole. In another exemplary embodiment of the invention, the sealing effect is increased by means of a double sealing lip.

In the exemplary embodiment shown in the FIGURE, the vehicle aerial (1) is constructed as a symmetrical radiating element. In another embodiment of the invention, the vehicle aerial (1) is constructed, as an asymmetrical radiating element, with an anti-rotation element provided for mounting the elastomer body on the body panel. The anti-rotation element is constructed in this embodiment by providing the opening in the vehicle body panel as an elongated hole, with the neck between the tip (3) and the base (2) having an appropriate corresponding cross-sectional shape.

According to a further embodiment of the invention an aerial with an integrated circuit is provided as an active aerial. Power is supplied either by means of an additional line, or the circuit is fed via an internal conductor of the coaxial line.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Aerial for a motor vehicle, of the type having a capacitive ground coupling and comprising:

a disk shaped aerial base portion which can be positioned inside a vehicle body of said motor vehicle;

an elongated aerial tip portion which extends from said base portion, and which in an installed position of said aerial extends through an opening in said vehicle body and projects away from said vehicle body;

an aerial wire having one end connected to a shielded high frequency line and another end which is integrated into said elongated aerial tip portion and, in an installed position of said aerial, extends outwardly from said vehicle body; and a contact plate which is embedded in said disk shaped aerial base portion on an upwardly exposed surface thereof and which contacts a shield of said high frequency line for capacitive ground coupling; wherein said disk shaped aerial base portion and said elongated aerial tip portion comprise a single component elastomer body;

a locking configuration is provided between said disk shaped aerial base portion and said elongated aerial tip portion for locking the elastomer body from inside said vehicle body in said opening therein, whereby said contact plate is electrically coupled with said vehicle body.

2. Aerial according to claim 1, wherein said locking configuration comprises a coaxially circumferential annular groove in the elastomer body, between the elongated aerial tip portion and the disk shaped aerial base portion, said annular groove having an internal diameter that is smaller than a diameter of the opening in the wall of the vehicle body.

3. Aerial according to claim 2, wherein a lower edge of the elongated aerial tip portion is provided in the region of the annular groove with a circumferential sealing lip for sealing the opening on an outer side of a wall of the vehicle body.

4. Aerial according to claim 1, wherein the aerial wire is at least partially molded into the elongated aerial tip portion.

5. Aerial according to claim 1, wherein the aerial wire is disposed along a longitudinal center axis of the elastomer body inside the tip portion.

* * * * *